United States Patent [19]

Nesbitt

[11] Patent Number: 4,878,265

[45] Date of Patent: Nov. 7, 1989

[54] HOLD-OPEN MECHANISM FOR USE WITH A DOOR CLOSER

[75] Inventor: Lanny E. Nesbitt, Strasburg, Pa.

[73] Assignee: Dorma Door Controls, Inc., Reamstown, Pa.

[21] Appl. No.: 241,917

[22] Filed: Sep. 7, 1988

[51] Int. Cl.[4] ..... E05C 17/04; E05F 3/00

[52] U.S. Cl. ..... 16/49; 16/DIG. 17; 292/262

[58] Field of Search ..... 16/48.5, 49, 51, 66, 16/DIG. 9, DIG. 10, DIG. 17; 292/193, 252, 262; 49/379

[56] References Cited

U.S. PATENT DOCUMENTS

| | | | |
|---|---|---|---|
| 3,415,562 | 12/1968 | Petersen | 292/273 |
| 3,764,172 | 10/1973 | Standke | 292/252 X |
| 3,771,823 | 11/1973 | Schnarr | 16/49 X |
| 3,964,125 | 6/1976 | Tansley | 16/48.5 |
| 4,040,143 | 8/1977 | Lasier et al. | 16/48.5 |
| 4,286,412 | 9/1981 | Stevens | 49/379 |
| 4,506,407 | 3/1985 | Downey | 16/49 X |
| 4,598,494 | 7/1986 | Tsuji et al. | 16/48.5 X |
| 4,663,800 | 5/1987 | Mettenleiter | 16/51 |

FOREIGN PATENT DOCUMENTS

| | | | |
|---|---|---|---|
| 33433 | 10/1921 | Norway | 292/193 |

*Primary Examiner*—Richard K. Seidel
*Assistant Examiner*—William S. Andes
*Attorney, Agent, or Firm*—Robert C. Podwil

[57] ABSTRACT

A releasable door hold-open mechanism, for use with a door closer, is disclosed. The mechanism employs a latch assembly, mounted in a track which defines a predetermined path for a slider shoe associated with a door closer arm. The latch assembly employs a pair of reciprocable rollers, associated with a solenoid activated clevis. When the solenoid is actuated, the clevis maintains the rollers in a latching position, in which they can capture and hold a wedge associated with the slider shoe. Deactivation of the solenoid permits release of the wedge, and the force of the solenoid can also be overcome manually to release the wedge. The latch assembly is selectively positionable in a broad range of positions within the track, to determine the angular position of the door at which holding occurs.

9 Claims, 3 Drawing Sheets

HOLD-OPEN MECHANISM FOR USE WITH A DOOR CLOSER

BACKGROUND OF THE INVENTION

This invention relates to a door hold-open mechanism for use with door closers, and more particularly, to an electrically controlled hold-open which may selectively be released or manually overridden.

It is conventional practice to provide doors in public buildings with hydraulic or spring-urged devices for automatically urging and returning doors to their closed positions. In some circumstances, it is desirable to temporarily defeat or overcome the action of the door closer, by providing a hold-open mechanism to maintain the door in its open position. Hold-open mechanisms may be made selectively releasable, often in response to a remote sensor such as a smoke detector. Examples of patents directed to hold-open mechanisms, among numerous others, are U.S. Pat. Nos. 3,771,823, issued Nov. 13, 1973, to Schnarr, 4,506,407, issued Mar. 26, 1985, to Downey, 4,286,412, issued Sept. 1, 1981, to Stevens and 4,663,800, issued May 12, 1987 to Mettenleiter, et al..

The present invention is directed to a mechanically simple yet effective releasable hold-open mechanism of the above general type, but which provides among its advantages a secure and reliable latching action, ease of release when release is desired, and the ability to provide for an infinitely adjustable angle of door opening within a desired range of between approximately 80° to 120° of door opening. Other objects and advantages of the invention will be apparent.

BRIEF SUMMARY OF THE INVENTION

In one presently preferred form, the invention is realized by a releasable hold-open mechanism in which a latching element, associated with a slider shoe, is coupled to the door closer arm and mounted for rectilinear movement along a predetermined path determined by a track. The closer may conveniently be mounted on the door, and the track on the stationary door frame. The slider shoe, coupled to the door closer arm, rides in the track and carries the latching element. A latch assembly is disposed in the track and adapted to be engaged by and to retain the latching element. The slider shoe approaches the latch assembly as the door approaches its open limit position.

The latch element associated with the slider shoe comprises a wedge with an enlarged head portion, provided with cam and latching surfaces. The latching surfaces of the wedge are "captured" when the slider engages the latch assembly by rollers mounted on the latch assembly, engageable with respective cam and latching surfaces of the wedge as the wedge moves into engagement with the latch assembly. A clevis, held in position by a solenoid, biases the rollers to the wedge-capturing position and has surfaces which cam the rollers into engagement with first the cam surfaces and then the latching surfaces as the wedge moves into engagement with the latch assembly.

The latch assembly is slidably mounted in the track, and secured at a selected position by means of set screws. The position of the latch assembly may readily be shifted, however, as desired, and such shifting serves selectively to adjust the angle at which the door is held open.

Deactivation of the solenoid relaxes the forces exerted by the clevis on the rollers, and causes the latch assembly to release the latching element, thus enabling the closer to close the door. When manual closing of the door is desired, force on the door causes the wedge to displace the rollers and, in turn, the clevis, overcoming the force of the solenoid and releasing the latching element and the door.

BRIEF DESCRIPTION OF THE DRAWINGS

For the purpose of illustrating the invention, there is shown in the drawings a form of the invention which is presently preferred, it being understood, however, that the invention is not limited to the precise arrangement and instrumentalities shown.

DETAILED DESCRIPTION

Figure 1:
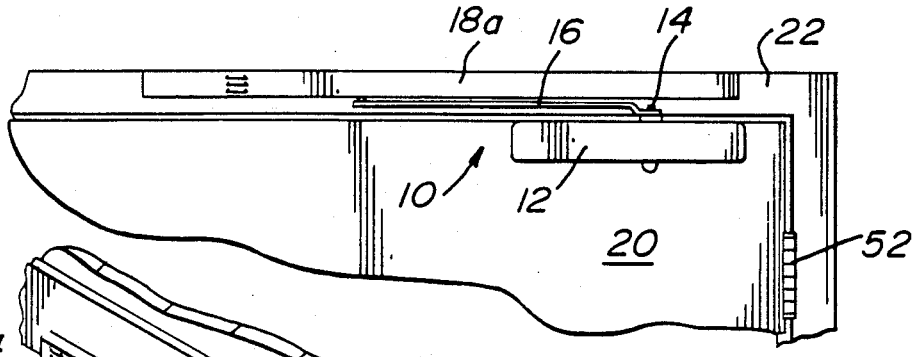
FIG. 1 is a partial elevation view, with portions broken away, showing apparatus in accordance with the invention mounted on a door and door frame, with the door in a closed position.
Figure 2:
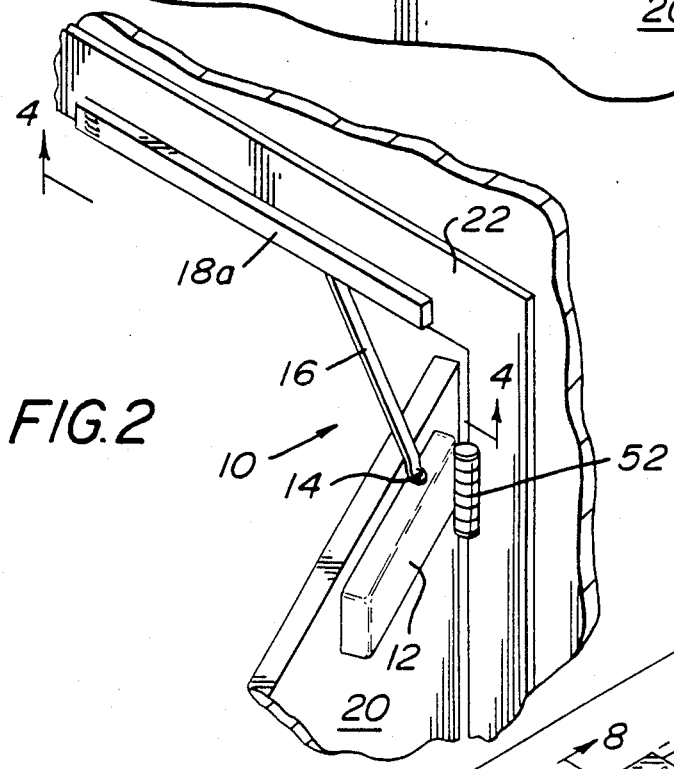
FIG. 2 is a perspective view, also with portions broken away, showing the apparatus on a door and door frame with the door at or near its fully open position.

Referring now the drawings in detail, wherein like reference numerals indicate like elements, there is seen in FIGS. 1 and 2 a releasable door hold-open mechanism, or apparatus, designated generally by the reference numeral 10. In general, the apparatus utilizes a conventional hydraulic door closer 12 of the well-known kind. Such closers provide a closing force by means of a hydraulically-damped spring-urged piston, whose linear motion is converted to rotary motion at an output shaft 14. Associated with the output shaft 14, and rotatable with it is an arm 16. As is explained in greater detail later, one end of the arm 16 is slidably coupled to an constrained by a track 18 (seen in FIGS. 3–9). The track 18 and other components may be disposed within a cover **18*a* as seen in FIGS. 1 and 2. In the illustrated arrangement, the door closer 12 is mounted on a door 20 and the track 18 and cover 18*a* on the fixed frame 22 of the door 20**.

Figure 3:
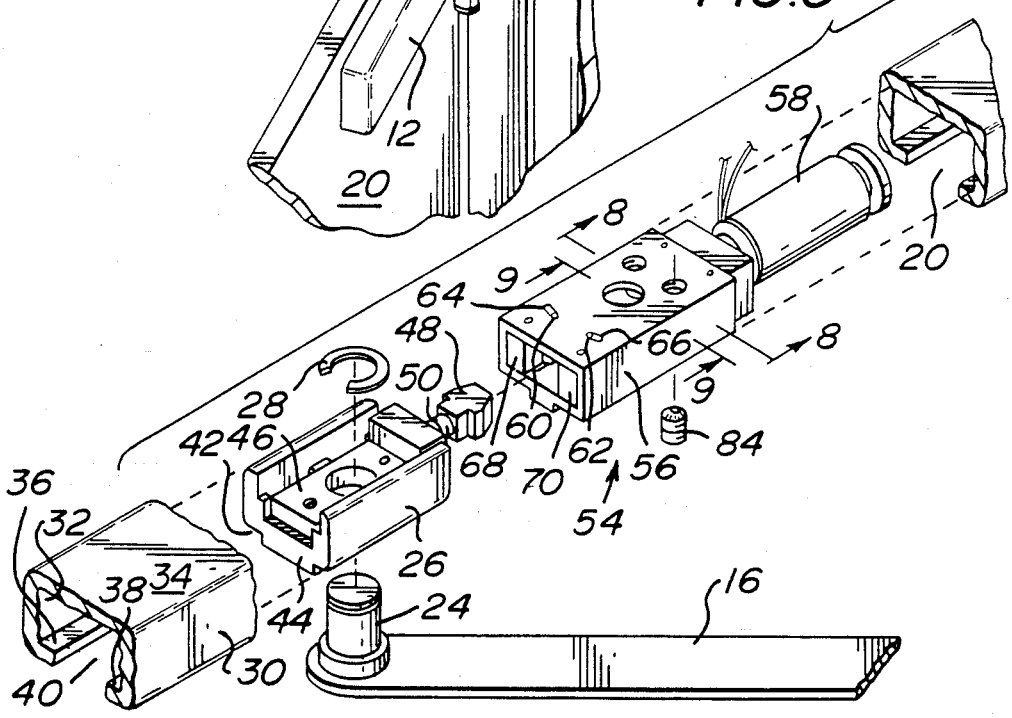
FIG. 3 is a perspective view, partially broken away, showing details of the present invention.

Referring now to FIG. 3, coupled to an end of the arm 16, by means of a pivot pin 24, is a slider shoe 26. A lock ring 28 or other suitable means may be used to secure the pivot pin 24 to the slider shoe 26 while allowing for rotation of the pivot pin 24 relative to the slider shoe 26.

Figure 9:
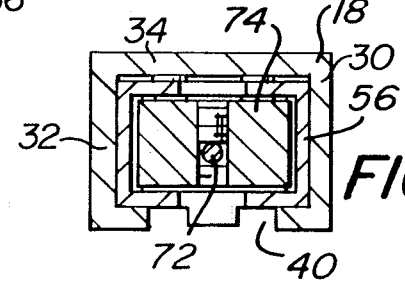
FIG. 9 is a transverse cross-sectional view taken along the line 9—9 in FIG. 3.
Figure 8:
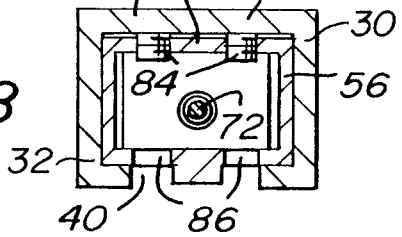
FIG. 8 is a transverse cross-sectional view taken along the line 8—8 in FIG. 3.

The track 18, as is seen in FIGS. 3, 8 and 9, is configured as an open channel, with side walls 30 and 32, a continuous top wall 34 and bottom flanges 36 and 38 defining therebetween a slot 40.

The slider shoe 26 comprises a block-like body, the height and width of which correspond generally to the internal dimensions of the track 18. The slider shoe 26 may ideally be provided, as illustrated, with relieved bottom corner portions 42, which define therebetween a guide flange 44 corresponding in with to the lower slot of the track 18.

The body of the slider shoe 26 is preferably of a tough, durable engineering plastic, such as acetal. Attached to the body is a metallic insert 46, to which there is affixed a wedge 48, preferably mounted on a threaded rod 50.

Figures 4, 5:
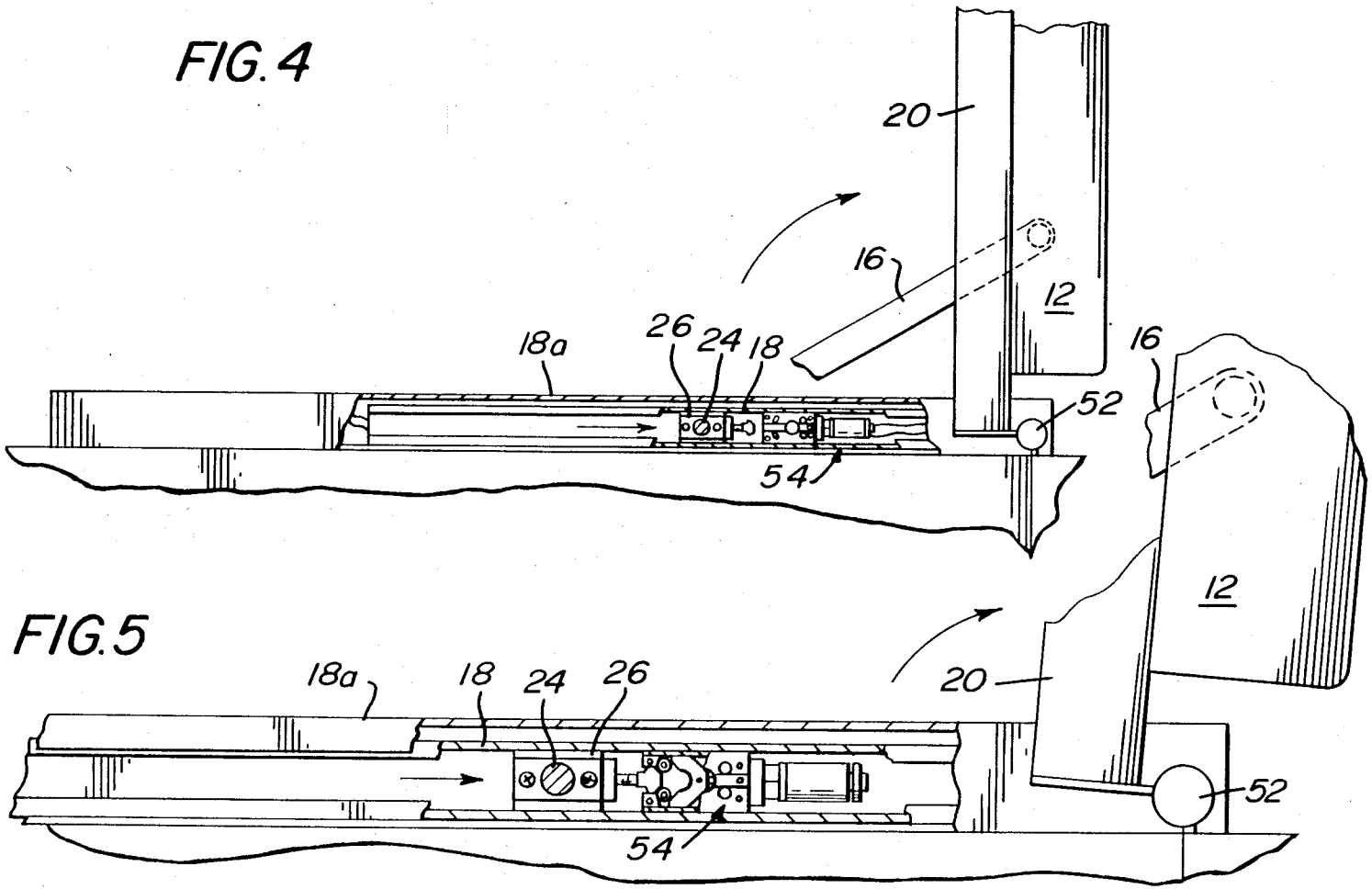
FIG. 4 is a bottom plan view, partially broken away, taken along the line 4—4 in FIG. 2.
FIG. 5 is a view somewhat similar to FIG. 4 but on a slightly larger scale, showing interaction of the latch assembly and wedge as the door approaches its open position.

Referring now to FIGS. 3, 4 and 5, it should be apparent that movement of the door 20 causes, in turn, movement of the arm 16 and translation of the slider 26 along the rectilinear path defined by the track 18. A comparison of FIGS. 4 and 5 illustrates the manner in which increased opening of the door 20 causes the slider 26 to move from an initial position spaced from a hinge 52 of the door 20 to a position closer to the hinge 52.

Referring again to FIG. 3, mounted within the track 18 is a latch assembly, designated generally by the reference numeral 54, which will now be described in detail.

The latch assembly 54 is mounted within a generally rectangular housing 56, to which there is affixed a solenoid 58.

Figure 6:
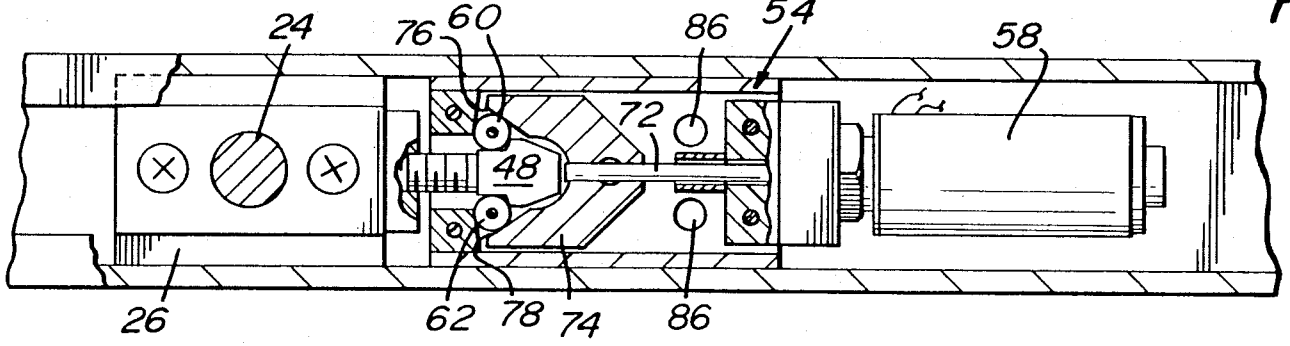
FIG. 6 is a view looking upwardly from below in a transverse horizontal plane, with portions partially broken away, showing the latch assembly and wedge in a latched position corresponding to the open position of the door.
Figure 7:
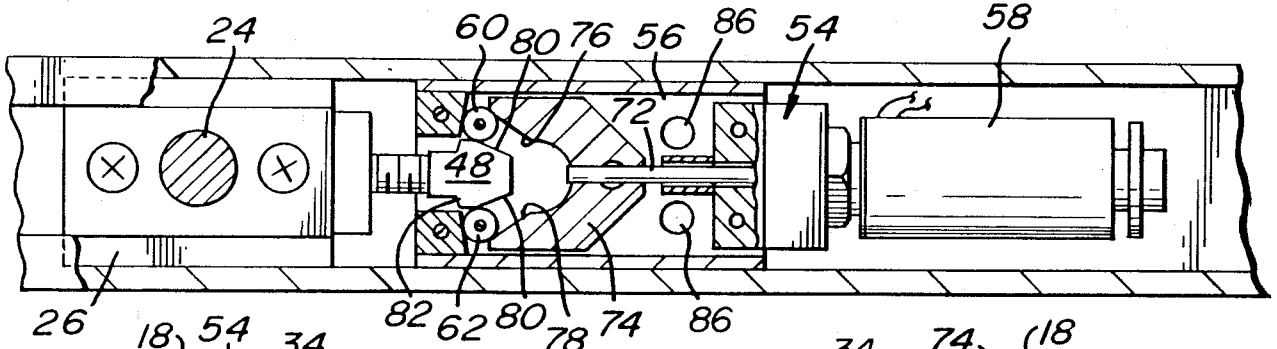
FIG. 7 is a view from a vantage point similar to that of FIG. 6, but showing the latch assembly and wedge just prior to engagement or disengagement.

Referring now to FIGS. 5, 6 and 7, mounted within the housing 54 are a pair of generally vertically oriented latch rollers 60 and 62. Referring again to FIG. 3, ends of the rollers 60, 62 are received in and guided by slots 64 and 66 in the upper and lower walls of the housing 56 (the slots in the lower wall being hidden in these views). The slots 64, 66 retain the latch rollers 60, 62 in association with housing 56, while allowing for oblique lateral movement of the rollers 60, 62 to facilitate their latching function as described below. Angle blocks 68 and 70, best seen in FIGS. 3, 6 and 7, also guide and constrain movement of the latch rollers 60, 62.

Coupled by a set screw (best seen in FIG. 9) to the operator rod 72 of the solenoid 58 is a clevis 74, the function of which will now be described. Referring now to FIGS. 6 and 7, the clevis 74 is provided with cam surfaces 76 and 78, disposed in planes parallel to the axes of the latch rollers 60, 62.

FIGS. 5, 6 and 7, illustrate, in sequence, the manner in which the wedge 48 (a latching element) becomes engaged with and is in a sense captured by the latch assembly 54. In FIG. 5, rotation of the door 12 and movement of the arm 16 has progressed to a point at which the wedge 48 projects between the angle blocks 68, 70 and into initial engagement with the latch rollers 60, 62. In FIG. 7, the slider shoe 26 has moved incrementally to the right, causing camming interengagement between oblique surfaces 80 of the wedge 48 and the latch rollers 60, 62. Such interengagement displaces the latch rollers 60, 62, causing them to move outwardly in their respective slots 64, 66 (seen in FIG. 3) with respect to the center line of the housing 56. Displacement of the latch rollers 60, 62 in the above-described manner causes, due to the angularity of the cam surfaces 76 and 78 of the clevis 74, an axially-directed component of force to the right in FIG. 7 sufficient to overcome the leftward bias of the energized solenoid 58.

Referring now to FIG. 6, the wedge 48 and latch assembly 54 are seen in a latched or fully engaged condition. In this condition, the latch rollers 60 and 62 are disposed near the inward extremities of their travel, and are wedged into those positions by engagement with the cam surfaces 76, 78 of the clevis 74. When thus-disposed, the latch rollers 60 and 62 are wedged by the action of the solenoid 58 behind the widest portion of the wedge 48, into engagement with latching surfaces 82, thus resisting withdrawal of the wedge 48 from engagement with the latch assembly 54. It will be seen in FIG. 6 that forces applied by the wedge 48 to the latch rollers 60 and 62 in the event that the slider shoe 26 is urged to the left in FIG. 6 are applied to generally inwardly disposed areas of the latch rollers 60 and 62, so as to avoid a self-latching "over-center" condition. From another perspective, the inwardly directed forces applied to the latch rollers 60, 62 by the clevis 74 under the urging of the solenoid 58 normally overcome outwardly directed forces which can be applied to on the latch rollers 60, 62 by the wedge 48 when the slider shoe 26 is urged toward the left in FIG. 6. Upon deenergization of the solenoid 58, with consequent relaxation of the forces applied to the latch rollers 60, 62 by the clevis 74, forces applied by the wedge 48 to the latch rollers 60, 62 are substantially unopposed, and the wedge 48 may spread the latch rollers 60, 62, thus enabling parting of the slide shoe 26 and the latch assembly 54.

When it is desired that the door 20 be closed manually, the application of substantial force to the door 20 in the direction of closing causes the wedge 48 to spread the latch rollers 60, 62 notwithstanding the bias of the solenoid 58, and once the latch is thus overcome, the operation of the closer 12 is sufficient to close the door.

Referring now to FIGS. 3 and 8, the manner in which the latch assembly 54 is secured within the track 18 should be apparent. In this regard, set screws 84 are threaded to the housing 56, and can project into engagement with the top wall 34 of the track 18. Relief openings 86 in the lower wall of the housing 56 provide access to the set screws 84. Tightening of the set screws precludes sliding of the housing 56 within the track 18. It will be appreciated that the location of the housing 56 is infinitely adjustable within a wide range, preferably one providing a range of adjustment between 80° and 120° of door swing.

The above-described latch assembly 54 provides satisfactory latching force, yet has a very low profile which enables it to fit completely and unobtrusively within the track 18. Moreover, the mechanical design of the latch assembly 54 and the manner in which it cooperates with the track 18 are such that they enhance the durability of the apparatus and its ability to resist damage. In this regard, the application of excessive force in the door-opening direction tends to cause sliding of the latch assembly 54 in the track 18 before damage occurs to the mechanism.

Although the electrical control of the solenoid 58 is not, by itself, a novel aspect of the present invention, those skilled in the art will appreciate that in addition to manually operable switches, a number of automatic arrangements can be incorporated into the apparatus to control the solenoid 58. For example, a photoelectric smoke detector can readily be housed within the cover 18a along with the track 18 and latch assembly 54. Existing fire and alarm control systems can also be made to control the solenoid 58, so that if an alarm state is signaled or a loss of current occurs, the latch assembly 54 releases and the door is permitted to close.

The present invention may be embodied in other specific forms without departing from its spirit or essential attributes, and accordingly, reference should be made to the appended claims rather than the foregoing specification of an indication of the scope of the invention.

I claim:

1. A releasable door hold-open mechanism for use with a door closer, comprising an enclosed track a latch element coupled to the door closer and mounted in said track for rectilinear movement along said track during door opening and closing movements, and a latch assembly disposed in said track and adapted to engage and retain said element to hold the door in an open limit position, said latch assembly being selectively positionable for substantially the length of said track to determine the open limit position, means coupled to said latch assembly and engageable with said track for selectively locking said latch assembly from movement relative to said track, whereby said latch assembly determines the open limit position, said latch assembly comprising a reciprocable roller engageable with said element, a clevis engageable with said roller to activate said roller to a latching position, and means for biasing said clevis to a roller-activating position, said clevis being so disposed and arranged as to cam said roller to an element-retaining position when said roller is in said roller-activating position.

2. A door hold-open mechanism in accordance with claim 1, wherein said means for biasing said clevis comprises a solenoid.

3. A door hold-open mechanism in accordance with claim 1, wherein said means coupled to said latch assembly comprises a set screw.

4. A releasable hold-open mechanism for use with a door closer, comprising an element coupled to the door closer and mounted for rectilinear movement along a predetermined path during door opening and closing movements, and a latch assembly disposed in said predetermined path and adapted to engage and retain said element to hold the door in an open limit position, a track member defining said predetermined path, said latch assembly being slidably received in said track member, and means operatively associated with said track member and said latch assembly to secure said latch assembly in position relative to said track member, said latch assembly being positionable relative to said track member for substantially the length of said track member, said element coupled to the door closer comprising a wedge having an enlarged head position having cam surfaces and latching surfaces thereon, said latch assembly comprising reciprocable rollers engageable with respective cam and latching surfaces of said wedge, a clevis engageable with said rollers to actuate said rollers to latching positions, and means for biasing said clevis to a roller-actuating position, said clevis being so disposed and arranged as to cam said rollers into engagement first with first said cam surfaces and then said latching surfaces as said wedge engages said latch assembly.

5. A door hold-open mechanism in accordance with claim 4, wherein said means for biasing said clevis to a roller-actuating position comprises a solenoid affixed to said latch assembly.

6. A door hold-open mechanism in accordance with claim 5, and said latching surfaces being so disposed and arranged as to enable a closing force manually applied to said door to overcome the biasing force of said clevis and enable the door to close.

7. In an electrically controlled door hold-open device, the combination comprising: a door closer, an element mounted for reciprocating movements along a predetermined path during door opening and closing movements, arm means connected between said door closer and said reciprocating element, said reciprocating element having a wedge-shaped latch-engaging member, a latch housing disposed in said path and adapted to be engaged by said latch-engaging member, a pair of reciprocable latch rollers disposed in said housing and movable relative to said housing and each other for latching and unlatching interengagement with said latch engaging member to provide door hold-open and release functions, a reciprocating clevis in said housing engageable with said latch rollers to actuate said rollers to a latching position, and solenoid means coupled to said housing and said clevis, said solenoid means when energized actuating said clevis to a hold-open position in which said clevis maintains said rollers in the latching position.

8. Apparatus in accordance with claim 7, wherein said latch-engaging member is wedge shaped and has camming and latching surfaces thereon for engagement with said latch rollers.

9. A releasable door hold-open mechanism for use with a door closer, comprising an elongated track, a latch element coupled to the door closer and operatively engaged with said track for movement along said track during door opening and closing movements, and a latch assembly disposed in said track and adapted to engage and retain said latch element to hold the door in an open limit position said latch assembly being selectively positionable along a substantial portion of said track to determine the angle of door swing at which the door is held open, said angle being in the range of about 80 to 120 degrees of swing, and means associated with said latch assembly to selectively secure said latch assembly in a selected position along said track.

* * * * *